US009410335B2

(12) United States Patent
Stubblefield et al.

(10) Patent No.: US 9,410,335 B2
(45) **Date of Patent: *Aug. 9, 2016**

(54) SYSTEM AND METHOD FOR PLUGGING CORE HOLES

(71) Applicants: Chris Stubblefield, Albuquerque, NM (US); Eddy Mindlin, Albuquerque, NM (US)

(72) Inventors: Chris Stubblefield, Albuquerque, NM (US); Eddy Mindlin, Albuquerque, NM (US)

(73) Assignee: Mesa Digital, LLC, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/040,975

(22) Filed: Sep. 30, 2013

(65) Prior Publication Data

US 2014/0298738 A1 Oct. 9, 2014

Related U.S. Application Data

(63) Continuation of application No. 12/481,430, filed on Jun. 9, 2009, now Pat. No. 8,572,913.

(60) Provisional application No. 61/059,969, filed on Jun. 9, 2008.

(51) Int. Cl.
*E04C 2/52* (2006.01)
*E04G 23/02* (2006.01)

(52) U.S. Cl.
CPC ..... *E04G 23/0203* (2013.01); *E04C 2/52* (2013.01); *E04G 23/0288* (2013.01)

(58) Field of Classification Search
CPC ... E04C 2/52; E04C 23/0203; E04C 23/0285; E04C 23/0288
USPC ..... 52/220.1, 220.8; 285/338; 174/50, 482, 174/483, 486, 490, 502
See application file for complete search history.

(56) References Cited

U.S. PATENT DOCUMENTS

| | | | | | |
|---|---|---|---|---|---|
| 2,052,384 | A | * | 8/1936 | Conran | 169/70 |
| 3,213,584 | A | * | 10/1965 | Bush | 277/649 |
| 3,578,027 | A | | 5/1971 | Zopfi | |
| 4,074,499 | A | | 2/1978 | Mess | |
| 4,301,629 | A | * | 11/1981 | Farr | 52/99 |
| 4,674,255 | A | * | 6/1987 | Derome | 52/750 |

(Continued)

FOREIGN PATENT DOCUMENTS

| | | | | |
|---|---|---|---|---|
| DE | EP 2458112 A1 | * | 5/2012 | E04G 17/0644 |
| FR | 2933112 A1 | | 1/2010 | |
| WO | WO 2007/012038 A2 | | 1/2007 | |

*Primary Examiner* — Rodney Mintz
(74) *Attorney, Agent, or Firm* — Luis M. Ortiz; Kermit D. Lopez; Ortiz & Lopez, PLLC

(57) ABSTRACT

A system, device, and method for plugging core holes. A core hole plug includes a top compression plate, a bottom compression plate, and a rubber expansion ring that separates the top and bottom compression plates. A beveled screw hole can be created on the top compression plate. The beveled screw hole matches the angle of the bottom surface of the head of a flat head bolt to ensure that the bolt remains flush with the top compression plate. The rubber expansion ring can be squeezed between the top and bottom compression plates as the flat head bolt is screwed into a threaded receiver nut formed on the bottom compression plate. An installation tool can be utilized to install the core hole plug so that the top compression plate remains flush with an existing floor surface.

19 Claims, 9 Drawing Sheets

(56) References Cited

U.S. PATENT DOCUMENTS 4,879,771 A 11/1989 Piskula
5,309,692 A * 5/1994 Hayashi et al. ..... 52/742.14
5,431,510 A * 7/1995 Reinert, Sr. ..... B64F 1/20 404/26
5,735,425 A 4/1998 Beadle
5,785,409 A * 7/1998 Reinert, Sr. ..... B64F 1/20 174/57
6,088,972 A 7/2000 Johanneck
6,378,269 B1 4/2002 Wiegand, Sr.
6,453,603 B1 9/2002 Baker
6,494,463 B1 * 12/2002 Rank ..... 277/607
6,662,490 B1 12/2003 Aesch, Jr.
7,053,296 B2 5/2006 Drane et al.
7,078,616 B2 7/2006 Roesch et al.
7,581,361 B1 * 9/2009 Murkland ..... 52/169.5
7,984,595 B2 7/2011 Reen
8,061,094 B2 11/2011 Struthers et al.
8,182,171 B2 5/2012 Poulsen
8,191,330 B1 6/2012 Cornwall
8,320,820 B2 * 11/2012 Ortiz ..... 455/3.01
8,438,807 B1 5/2013 Cornwall
8,572,913 B2 * 11/2013 Stubblefield et al. ..... 52/220.1
8,661,758 B2 * 3/2014 Longhenry ..... 52/514
8,769,890 B2 * 7/2014 Amin ..... 52/220.8
8,959,863 B2 * 2/2015 Gray et al. ..... 52/514
8,959,873 B2 * 2/2015 Longhenry ..... 52/741.4
8,978,341 B2 * 3/2015 Maanum et al. ..... 52/742.13
9,145,696 B2 * 9/2015 Gray ..... E04G 23/0285 52/514
2003/0009961 A1 1/2003 Radke et al.
2003/0014905 A1 1/2003 Baker
2004/0016190 A1 1/2004 Radke et al.
2005/0120660 A1 6/2005 Kim et al.
2007/0014102 A1 1/2007 Drane et al.
2007/0113490 A1 * 5/2007 Boyd ..... 52/133
2008/0216432 A1 9/2008 Cannistraro et al.
2008/0272278 A1 11/2008 Shewa et al.
2008/0314902 A1 * 12/2008 Dayton et al. ..... 220/235
2009/0320391 A1 * 12/2009 Stubblefield et al. ..... 52/220.1
2011/0076111 A1 3/2011 Suefuji et al.
2011/0101614 A1 5/2011 Raillard
2011/0192104 A1 * 8/2011 Longhenry ..... 52/514.5
2011/0212682 A1 * 9/2011 Ortiz ..... 455/3.06
2011/0212683 A1 * 9/2011 Ortiz ..... 455/3.06
2013/0312354 A1 * 11/2013 Johnson et al. ..... 52/514
2014/0174024 A1 * 6/2014 Longhenry ..... 52/741.3

* cited by examiner

SYSTEM AND METHOD FOR PLUGGING CORE HOLES

APPLICATION PRIORITY

The present application claims priority as a Continuation Application to U.S. patent application Ser. No. 12/481,430, entitled "Systems and Methods for Plugging Core Holes" filed Jun. 9, 2009, which further claims priority as a continuation to U.S. Provisional Patent Application No. 61/059,969, entitled "Core Hole Floor Plugs, Installation System and Methods of Use" filed Jun. 9, 2008. The disclosures of the above applications are incorporated herein by reference.

FIELD OF THE INVENTION

Embodiments are generally related to core hole plugs. Embodiments are further related to methods and systems for installing core hole plugs.

BACKGROUND

Core holes are often cut into existing concrete and wood flooring in commercial and residential buildings in order to provide access to various utilities and to retrofit the building for wiring, plumbing, and the like. The conventional core holes are about three inches, or more, in diameter. Such core holes are typically bored into the concrete or cut into the wood flooring of multi story buildings. In most cases, core holes are only required temporarily and must be re-plugged after the need for access ceases. One such case is in commercial buildings, where a new tenant no longer requires the holes that may have been required to provide a prior tenant access throughout a leased space for equipment requiring data or power. In some other cases, an owner of the building can require equipment to be relocated, which also necessitates re-patching of the core holes and installation of new ones.

In majority of prior art approaches, concrete is utilized to patch the existing core holes. In general, concrete can permanently close the core hole avoiding future access. In one prior art implementation a core hole cover is alternatively utilized to reserve future access of the core holes. Such core hole covers, however, unfortunately leave a bump, which can cause a hazard and liability if the area is frequently walked over by tenants. Such bumps can lead to tripping and can also create an unsightly bulge if covered by other flooring (e.g., carpeting).

Based on the foregoing, it is believed that a need exists for improved methods and system for plugging core holes on grade with existing flooring surfaces. A need also exists for an improved core hole plug assembly that is unobtrusive, easily installable, and can reserve future access through core holes.

SUMMARY

The following summary is provided to facilitate an understanding of some of the innovative features unique to the disclosed example embodiments and is not intended to be a full description. A full appreciation of the various aspects of the example embodiments disclosed herein can be gained by taking the entire specification, claims, drawings, and abstract as a whole.

It is one aspect of the disclosed embodiments to provide for improved core hole plugs.

It is another aspect of the disclosed embodiments to provide an improved core hole floor plug system.

It is yet another aspect of the disclosed embodiments to provide an improved core hole floor plug system including an installation tool.

It is yet another aspect of the disclosed embodiments to provide an improved core hole floor plug including electrical connections (e.g., lighting, data, electrical power plugs, solar panel) integrated within a top plate of the core hole plug.

It is another aspect of the disclosed embodiments to provide for an improved method for installing core hole floor plugs.

The aforementioned aspects and other objectives and advantages can now be achieved as described herein. A system and method for plugging core holes is disclosed. A core hole plug includes a top compression plate, a bottom compression plate, and a rubber expansion ring that separates the top and bottom compression plates. A beveled screw hole can be provided on the top compression plate. The beveled screw hole can match the angle of the bottom surface of the head of a Flat head bolt to ensure that the bolt remains flush with the top compression plate. The rubber expansion ring can be squeezed between the top and the bottom compression plates as the flat head bolt is screwed into a threaded receiver nut formed on the bottom compression plate. The rubber expansion ring can be squeezed as the bottom compression plate is pulled toward the top compression plate by the flat head bolt.

An installation tool can be utilized to install the core hole plug so that the top compression plate remains flush with an existing floor surface. The installation tool can be provided in the form of a flat bar having a top and bottom surface that can be temporarily attached to the top surface of the top compression plate with at least one thumbscrew. The installation tool ideally extends across and past the outer perimeter of the top compression plate. When the core hole plug is inserted into a core hole, the bottom surface of the installation tool can extend past the top compression plate and comes into contact with the surface of existing flooring surrounding the core hole. Consequently, the flat head bolt can then be tightened until the core hole floor plug is secured within the hold. The installation tool can then be removed from the core hole plug by removing the thumbscrew retaining the installation tool to the top compression plate. The surface of the top compression plate can remain flush with the top surface of surrounding flooring following installation of the core hole plug using the installation tool.

The core hole plug can be removed easily for access as needed and if not removed, the core hole plug does not cause any obstruction on the existing flooring surface (e.g., no bulge underneath carpeting). The core hole plug can be provided in a variety of shapes and sizes (e.g., round, square, rectangular, etc.) and with varying thickness. Furthermore, the core hole plug can also be provided as a waterproof unit with integrated lighting sources, data connection, and electrical power connections. Such a core hole plug can also provide flexibility for existing commercial and residential buildings, which may need additional electrical or data outlets.

BRIEF DESCRIPTION OF THE FIGURES

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof.

Figure 1:
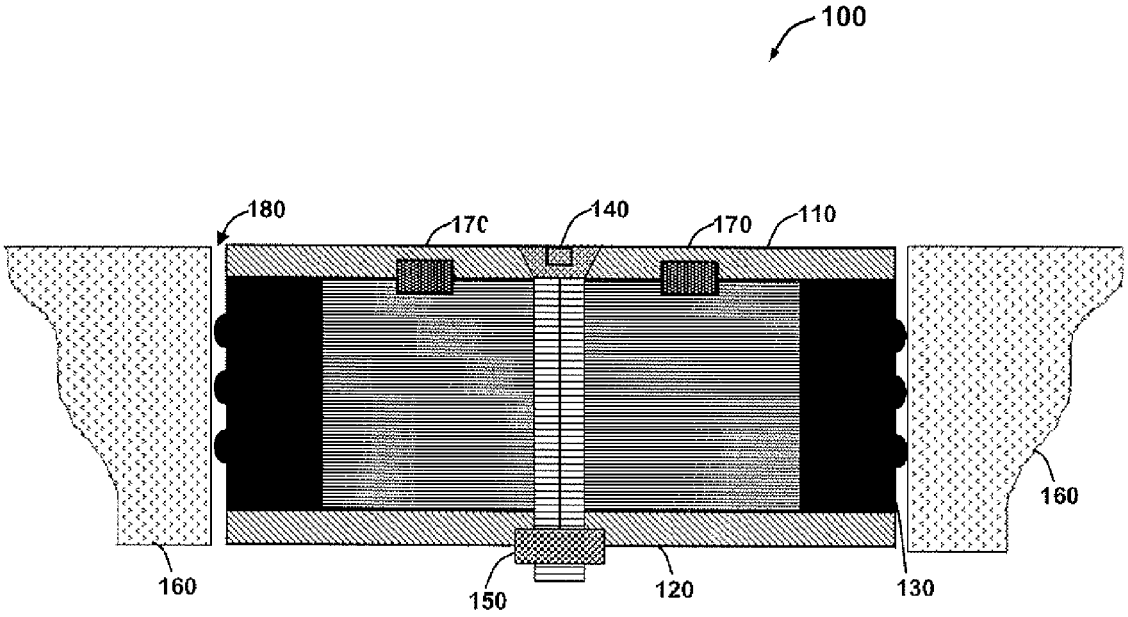
FIG. 1 illustrates a perspective view of a core hole plug installed within a core hole formed in flooring, in accordance with a preferred embodiment.

FIG. 1 illustrates a perspective view of the core hole plug 100, in accordance with a preferred embodiment. In general, the core hole plug 100 can be utilized in several applications such as, for example, a duct system, raised access flooring, multi-story buildings, and the like. The core hole plug 100 can also be utilized to provide access to data wiring, utility wiring, plumbing, and other utilities that may be required for industrial, commercial, and residential applications. Core hole plugs 100 as taught herein are designed to be surface flush mounted within core holes 180.

The core hole plug 100 generally includes a top compression plate 110, a bottom compression plate 120, and a rubber expansion ring 130. The rubber expansion ring 130 separates the top compression plate 110 and the bottom compression plate 120. The rubber expansion ring 130 can be squeezed between the top compression plate 110 and the bottom compression plate 120 as a flat head bolt 140 is screwed into a threaded receiver nut 150 formed on the bottom compression plate 120. The rubber expansion ring 130 can be compatible with various wall or surface structures 160.

The rubber expansion ring 130 can be cylindrical with a tubular sidewall. The rubber expansion ring 130 can be configured from a material such as, for example, deformable and resilient polymeric material. The properties of the deformable and resilient polymeric material enable the rubber expansion ring 130 to return to its original diameter and shape when the rubber expansion ring 130 is not under compression. Preferably, the material forming the expansion ring 130 can also be durable and chemical resistant. The threaded receiver nut 150 can be welded or otherwise affixed non-rotatably with the bottom compression plate 120.

The rubber expansion ring 130 is compressed by tightening the flat head bolt 140 and drawing the bottom compression plate 120 towards the top compression plate 110. The rubber expansion ring 130 extends in diameter to force the outside surface of the expansion ring 130 into contact with the sidewall of a core hole 180. The extended rubber expansion ring 130 secures the core hole plug 100 in place and forms a seal between the outside surface of expansion ring 130 and the sidewall of the hole 180. Thereafter, the bolt 140 can be loosened and the rubber expansion ring 130 is allowed to return to its initial shape and diameter. Consequently, the outside surface of the expansion ring 130 draws away from the sidewall of the hole 180 and the core hole plug 100 can be easily removed as a unit without fear of losing compression plates 110 and 120.

Figure 2:
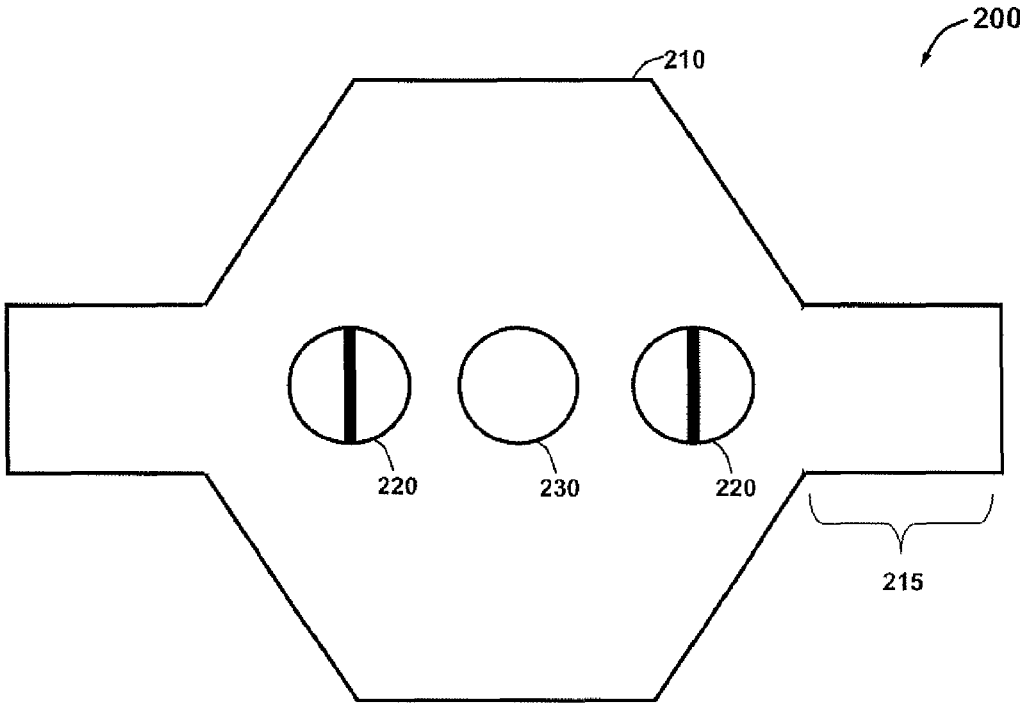
FIG. 2 illustrates a perspective view of a core hole plug installation tool associated with a thumbscrew, in accordance with a preferred embodiment.

FIG. 2 illustrates a perspective view of a core hole plug installation tool 200 associated with a thumbscrew 220, in accordance with a preferred embodiment. Note that in FIGS. 1-9, identical or similar blocks are generally indicated by identical reference numerals. The installation tool 200 can include at least one thumbscrew 220 so that the installation tool can be affixed to the top compression plate 110 of the core hole plug 100. An access hole 230 can be provided for accessing the flat head bolt 140. The flat head bolt 140 can be tightened and loosened utilizing a wrench, a screwdriver, or other tool through the access hole 230. The installation tool 200 can be utilized to install the core hole plug 100 so that the top compression plate 110 remains flush with an existing floor surface 160.

Figure 3:
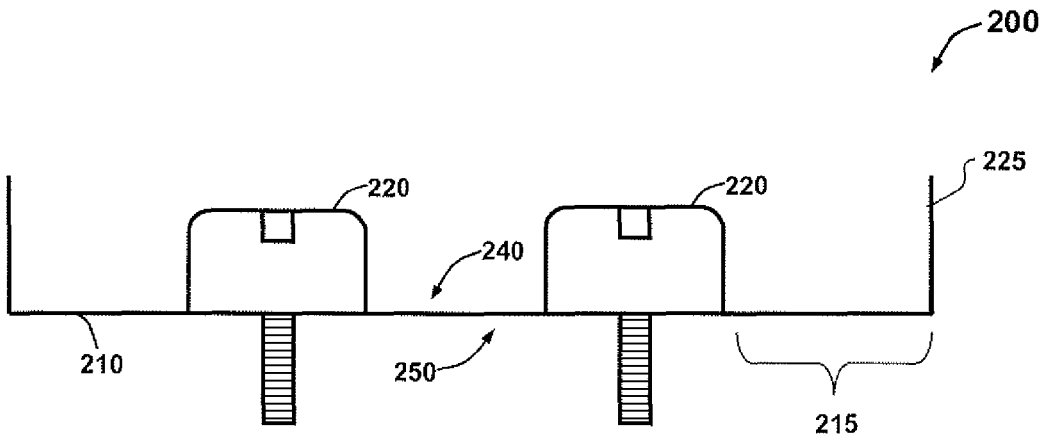
FIG. 3 illustrates a side view of the core hole plug installation tool, in accordance with a preferred embodiment.

FIG. 3 illustrates a side view of the core hole plug installation tool 200, in accordance with a preferred embodiment. The installation tool 200 can be provided in the form of a flat bar 210 having a top surface 240 and a bottom surface 250. The installation tool can be temporarily attached to the top surface of the top compression plate 110 with the thumbscrews 220. The installation tool 200 can extend across and past the outer perimeter of the top compression plate 110 as shown by bracket 215. The bottom surface 250 of the installation tool 200 comes into contact with existing flooring surface 160 when the core hole plug 100 is inserted into the core hole 180. The flat head bolt 140 can then be tightened until the core hole floor plug 100 is secured. Thereafter, the installation tool 200 can be removed from the core hole plug 100 by removing the thumbscrews 220 retaining the installation tool 200 to the top compression plate 110. Optional handles 225 can be provided on the tool 200 (e.g., extending upward from the tool 200 and can be used to grip the tool 200).

Figure 4:
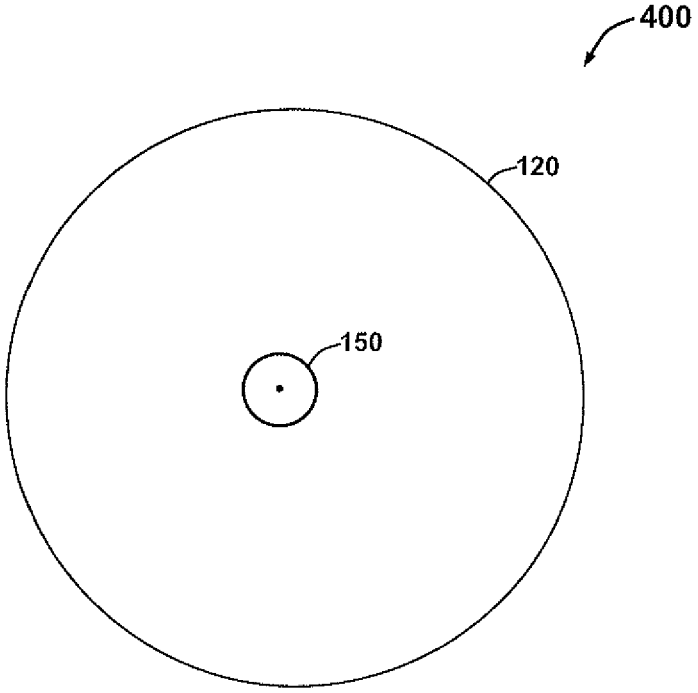
FIG. 4 illustrates a perspective view of a bottom compression plate of the core hole plug associated with threaded screw receiver, in accordance with a preferred embodiment.

FIG. 4 illustrates a perspective view 400 of the bottom compression plate 120 of the core hole plug 100 associated with one or more threaded screw receiver nuts 150, in accordance with a preferred embodiment. The top compression plate 110 and the bottom compression plate 120 can be configured from a material such as, for example, stainless steel or durable plastic or some other durable, preferably non-corrosive and chemical resistant material. The bottom compression plate 120 can be permanently secured to the lower portion of the rubber expansion ring 130, preferably, by being molded into or otherwise completely embedded within the lower end portion of the rubber expansion ring 130 to form a lowermost disk shaped layer in the core plug 100. The bottom compression plate 120 is secured non-rotatably in order to avoid rotation relative to the rubber expansion ring 130.

Figure 5:
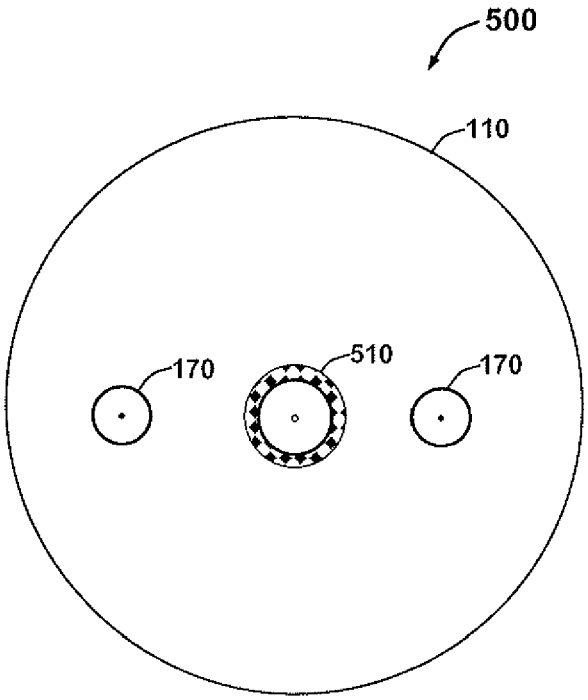
FIG. 5 illustrates a top view of a top compression associated with the core hole plug, in accordance with a preferred embodiment.

FIG. 5 illustrates a perspective view of the top compression plate 110 for the core hole plug 100, in accordance with a preferred embodiment. The top compression plate 110 includes one or more thumbscrews receiving nut 170, which can be utilized to affix the top compression plate 110 to the installation tool 200. The head of the flat head bolt 140 can be received within the recess of a beveled screw receiver 510 so that the head of the bolt 140 is flush or substantially flush with the upper surface of the top compression plate 110. The beveled screw receiver 510 can be, but not limited to, ¼-20 in size. The top compression plate 110 can be greater in diameter than the diameter of the rubber expansion ring 130.

Figure 6:
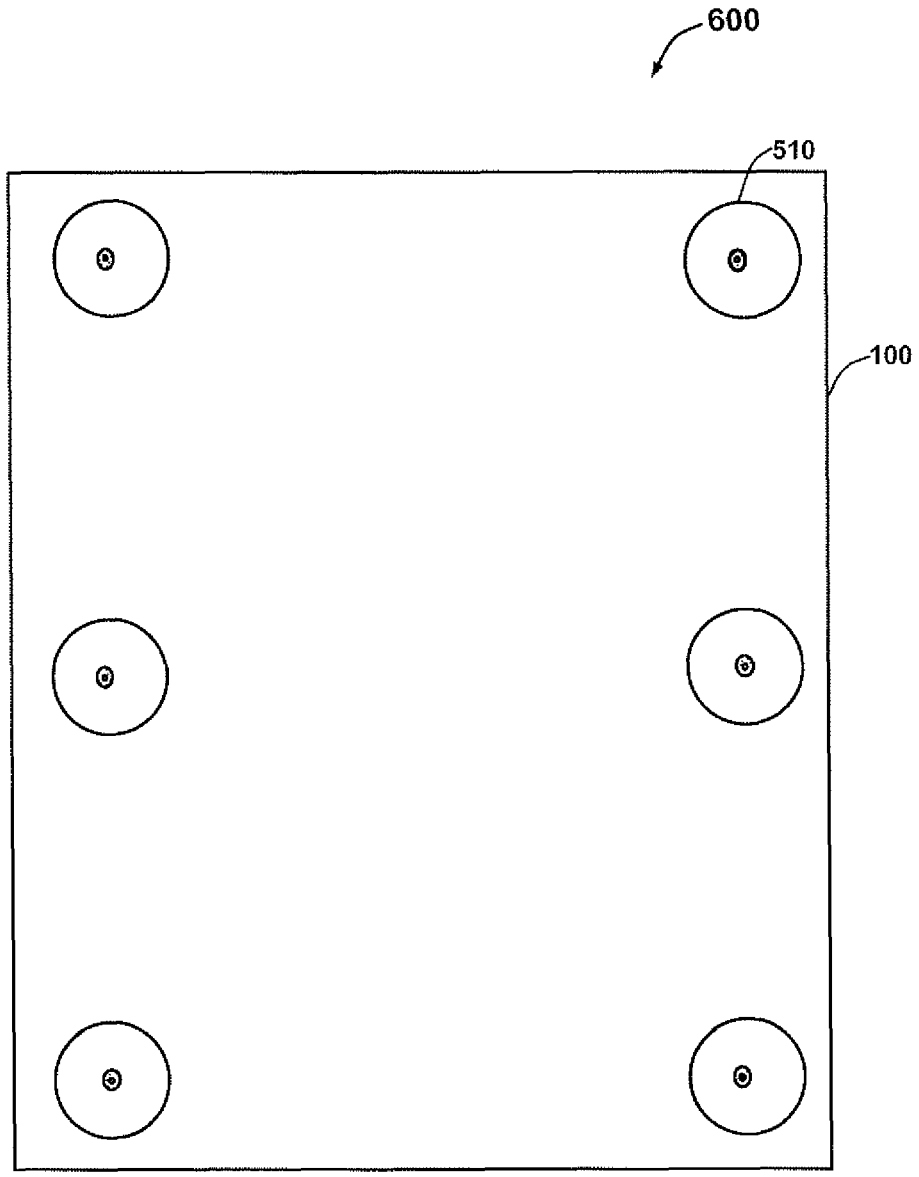
FIG. 6 illustrates a top view of a rectangle core hole plug comprising six beveled screw receivers, in accordance with an exemplary embodiment.
Figure 7:
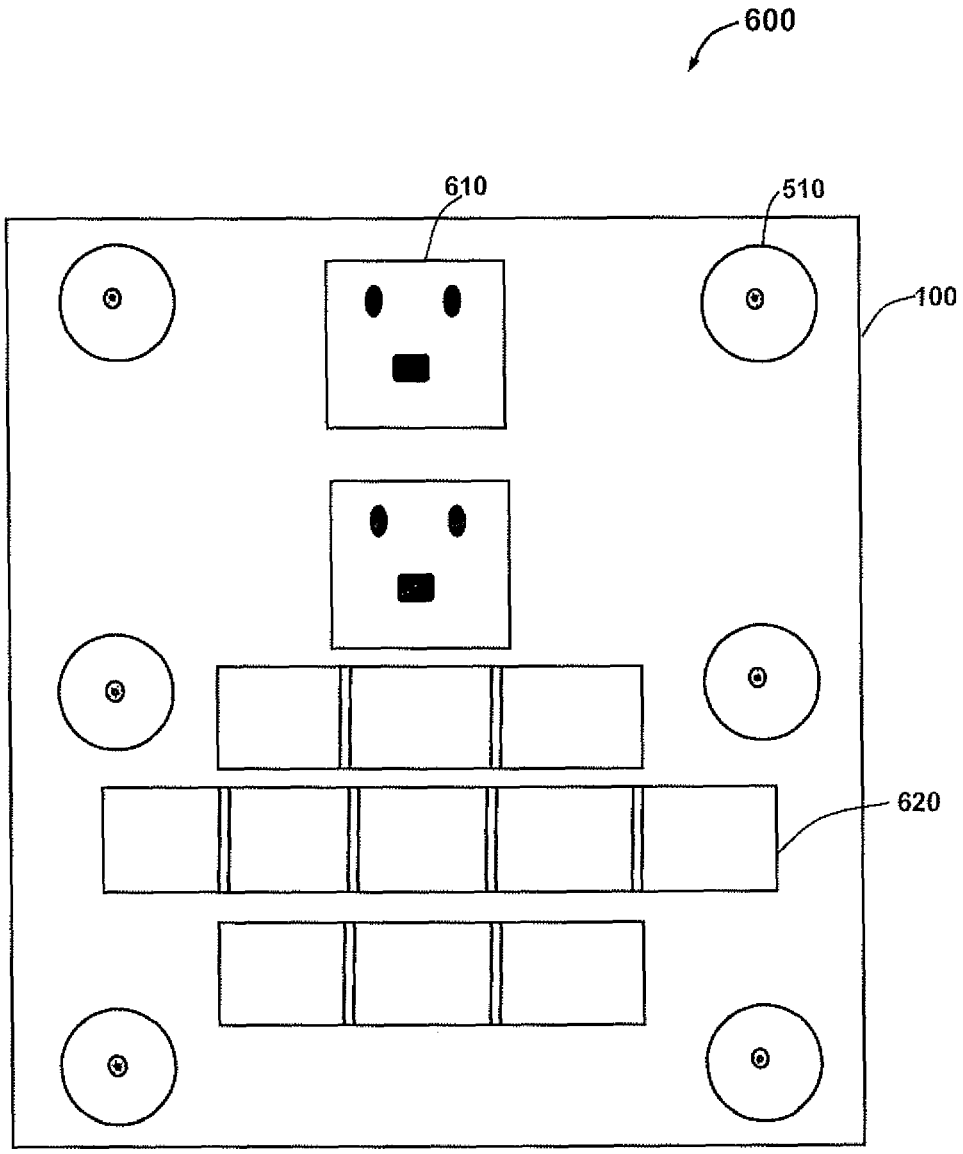
FIG. 7 illustrates a top view of the rectangular core hole plug comprising six beveled screw receivers, data plugs, and switches, in accordance with an exemplary embodiment.

FIG. 6 illustrates a top view of a rectangular core hole plug 600 including beveled screw receivers 510, in accordance with an exemplary embodiment. The rectangular core hole plug 600 can include more than one beveled screw 510 for evenly plugging a rectangular core hole. The rectangular core hole plug 600 can be adapted to include electrical power and data plugs for electrical connections in the enclosed structures. FIG. 7 illustrates a top view of the rectangular core hole plug 600 including six beveled screw receivers 510, data plugs 610, and switches 620, in accordance with an exemplary embodiment. A number of switches 620 can be included in the rectangle core hole plug 600 for on/off operation of the devices connected to the power and data plugs 610. The adaptation of electrical power and data plugs 610 can provide flexibility for commercial and residential buildings needing additional electrical or data outlets.

Figure 8:
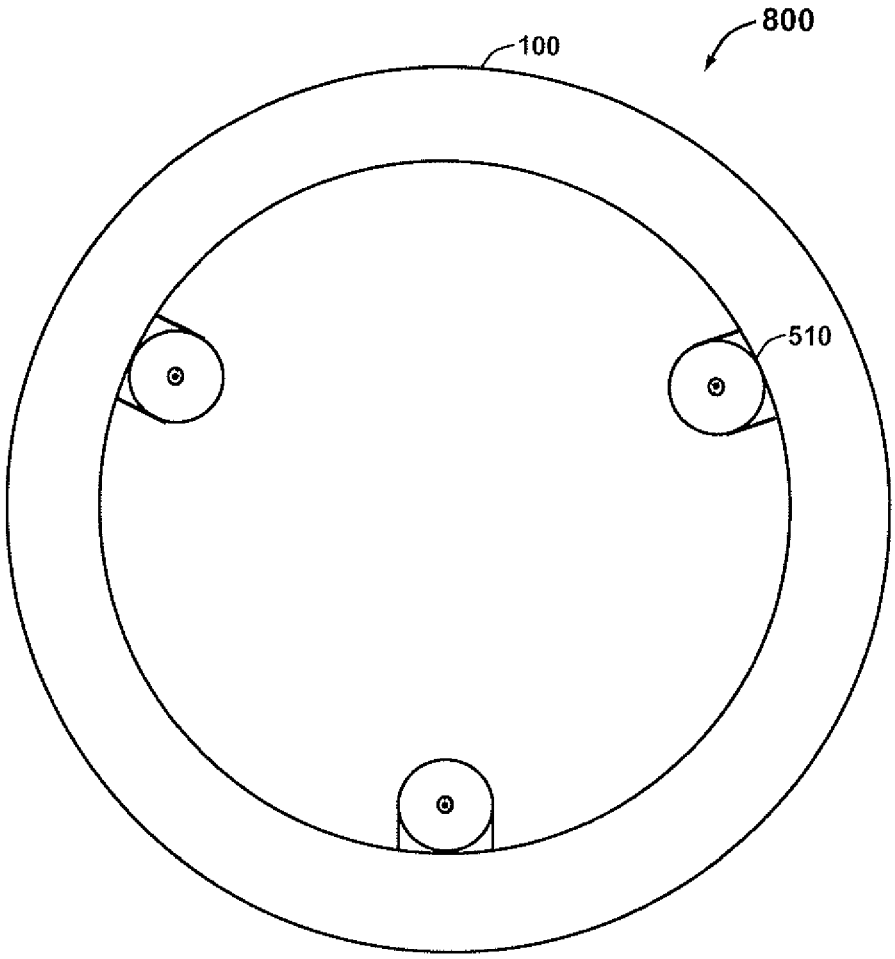
FIG. 8 illustrates a top view of a circular core hole plug comprising three beveled screw receivers, in accordance with an exemplary embodiment.
Figure 9:
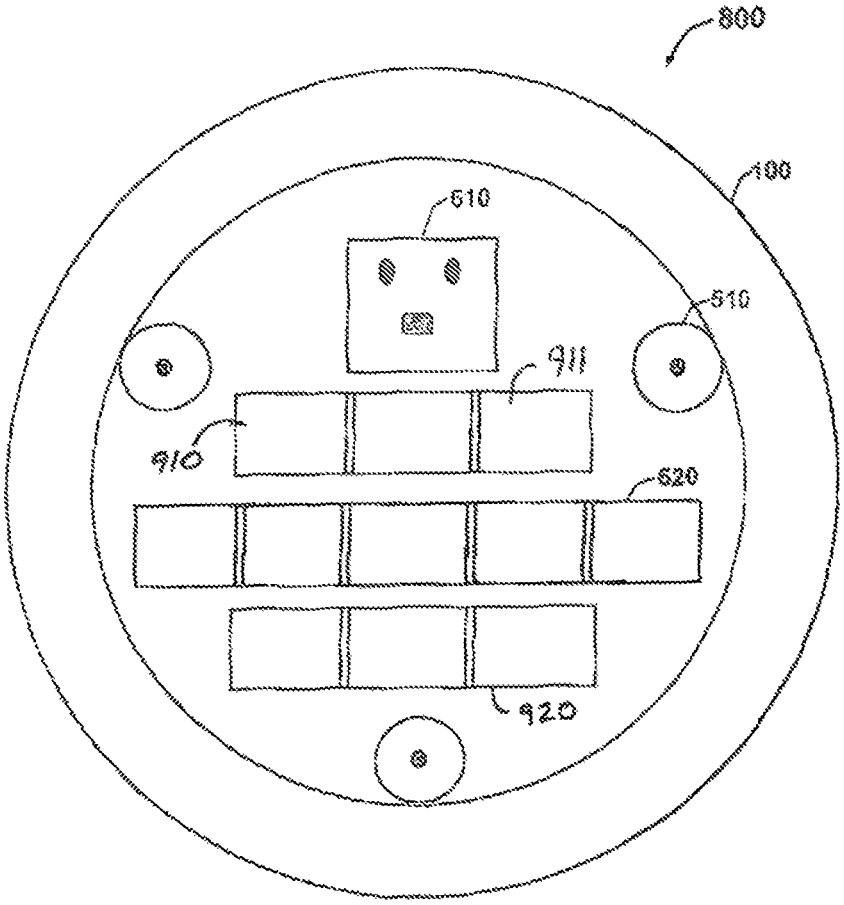
FIG. 9 illustrates a top view of the circular core hole plug comprising three beveled screw receivers, data plugs, and switches, in accordance with an exemplary embodiment.

FIG. 8 illustrates a top view of a circular core hole plug 800 including beveled screw receivers 510, in accordance with an exemplary embodiment. The circular core hole plug 800 can include three beveled screws 510 for evenly plugging a circular core hole. The circular core hole plug 800 can also include electrical power and data plugs 610 for electrical connections in the enclosed structures. FIG. 9 illustrates a top view of the circular core hole plug 800 including three beveled screw receivers, the data plugs 610, and the switches 620, in accordance with an exemplary embodiment. A number of switches 620 can be included in the circular core plug 800 for on/off operation of the devices connected to the power and data plugs 610.

Referring again to FIG. 9, the core hole plug 100, 600 and 800 described herein can, instead or also, include integrated lighting 910 within the top compression plate 110, which can be provided as glow plate material or can be electrified. If electrified, the integrated lighting 910 can be powered by a solar panel 911, wherein said integrated lighting 910 and solar panel 911 can be integrated in the top compression plate 110. A hard lens 920 can also be provided within or take the place of the top compression plate 110 in order to provide for a lighting application. The lighting applications can be utilized for interior pathway lighting or exterior pathway lighting applications. The core hole plug 100 can also be provided as a waterproof unit.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art, which are also intended to be encompassed by the following claims.

What is claimed is:

1. A core hole plug installation system for installing core hole plugs into a surrounding flooring surface in a manner that the core hole plugs are flush with the surrounding flooring surface, comprising:

an installation tool temporarily attachable to a top surface of a top compression plate of the core hole plug, said core hole plug including said top compression plate and a bottom compression plate, wherein said top compression plate and said bottom compression plate are attached by at least one flat head bolt and are separated by a rubber expansion ring, wherein said top compression plate, said bottom compression plate and said rubber expansion ring have a diameter smaller than a core hole formed in the flooring surface that said top compression plate, said bottom compression plate and said rubber expansion ring will be installed into, and wherein said rubber expansion ring expands and contacts side walls of the core hole as the bottom compression plate and said top compression plate are mechanically squeezed together by said at least one flat head bolt, wherein said installation tool extends across and past an outer perimeter of said top compression plate and wherein said installation tool comes in contact with the surrounding flooring surface when said core hole plug is inserted into the core hole to keep the top compression plate even with the surrounding flooring surface; and at least one screw for temporarily attaching said installation tool onto said top compression plate of said core hole plug.

2. The system of claim 1, wherein said at least one screw for temporarily attaching said installation tool onto said top compression plate of said core hole plug further comprises at least one thumb screw receiver.

3. The system of claim 1, wherein the outer perimeter define an outer diameter of the top compression plate and said installation tool extends across and past the outer diameter of said top compression plate.

4. The system of claim 1, wherein said at least one flat head bolt is tightened until said core hole plug is secured within the core hole.

5. The system of claim 1, wherein said core hole plug comprises at least one of the following shapes: rectangular, square, or circular.

6. A core hole plug installation system, comprising:

a core hole plug having a top compression plate having a top surface and a bottom compression plate wherein said top compression plate and said bottom compression plate are separated by a rubber expansion ring, and wherein said top compression plate, said bottom compression plate and said rubber expansion ring have a diameter smaller than a core hole that said top compression plate, said bottom compression plate and said rubber expansion ring will be installed into;

wherein said top compression plate has at least one beveled screw hole formed in the top surface of said top compression plate, wherein said at least one beveled screw hole matches an angle of a bottom surface of a head of at least one flat head bolt to ensure that said at least one flat head bolt remains flush within said top compression plate;

said at least one flat head bolt screwed into at least one threaded receiver nut through the at least one beveled screw hole wherein said at least one flat head bolt connects said top compression plate and said bottom compression plate of said core hole plug with said rubber expansion ring therebetween; and a flat installation tool having a top and a bottom surface, said bottom surface of the flat installation tool attachable to the top surface of said top compression plate with at least one screw, wherein said installation tool comes into contact with an existing floor surface when said core hole plug is inserted into the core hole formed in the existing floor surface for installation.

7. The system of claim 6, wherein said installation tool extends across and past an outer perimeter of said top compression plate.

8. The system of claim 6, wherein said at least one flat head bolt is tightened until said core hole plug is secured within the core hole.

9. The system of claim 6 wherein said core hole plug comprises at least one of the following shapes: rectangular, square, or circular.

10. The system of claim 6, wherein said core hole plug further comprises at least one of: lighting integrated within the top compression plate.

11. The system of claim 6, wherein said core hole plug further comprises at least one of: lighting integrated within the top compression plate; at least one electrical connection plug integrated within the top compression plate; solar lighting integrated within the top compression plate.

12. The system of claim 6, further comprising:

at least one screw receiver formed in said top compression plate for temporarily attaching said installation tool on said top compression plate of said core hole plug.

13. The system of claim 12, wherein said at least one screw receiver is configured to accept the at least one screw for temporarily attaching said installation tool on said top compression plate of said core hole plug with the at least one screw.

14. The system of claim 12, wherein said installation tool extends across and past an outer perimeter of said top compression plate.

15. A core hole plug installation method, comprising:

providing a core hole plug further comprising a top compression plate including a top surface defined by an outer diameter and having a beveled screw receiver located at a center of said top surface, a bottom compression plate including a threaded receiver nut at a center of said bottom plate, a rubber expansion ring separating said top compression plate and said bottom compression plate, and a flat head bolt, wherein said at least one beveled screw receiver matches an angle of a bottom surface of a head of said flat head bolt to ensure that said flat head bolt remains flush when inserted within said top compression plate, and said at least one flat head bolt is screwable into said threaded receiver nut through the at least one beveled screw receiver, wherein said at least one flat head bolt connects said top compression plate and said bottom compression plate of said core hole plug with said rubber expansion ring located there between;

attaching a flat installation tool including a top and a bottom surface to the top surface of said top compression plate, wherein the bottom surface of the flat installation tool sits flush against the top surface of the top compression plate, the flat installation tool remains clear of the beveled head receiver when attached to the top surface of said top compression plate, and the flat installation tool extends outside the outer diameter defining said top compression plate;

inserting the core hole plug into a core hole having a larger diameter than the top compression plate, said rubber expansion ring when uncompressed, and said bottom compression plate until the bottom surface of the installation tool comes into contact with an existing floor surface surrounding the core hole when said core hole plug is inserted into the core hole;

turning the flat head bolt causing the bottom compression plate to be drawn toward the top compression plate and installation tool as the installation tool lies flat against the existing floor surface, and said turning continues until said rubber expansion ring expands in diameter forcing an outside surface of the expansion ring into contact with a sidewall of the core hole located between the top and bottom compression plates, wherein the rubber expansion ring secures the core hole plug in place with the top surface of said top compression plate being level to the existing flooring surface and forms a seal between the outside surface of expansion ring and the sidewall of the core hole once compressed by the top and bottom compression plates; and removing the installation tool from the top compression plate thereby leaving the core hole plug installed in the core hole formed in the existing flooring surface with said top surface of said top compression plate flush with the existing floor surface.

16. The method of claim 15, wherein said installation tool is attached to said top compression plate by at least one thumb screw.

17. The method of claim 15, wherein said installation tool extends across and past an outer perimeter of said top compression plate.

18. The method of claim 15, wherein said at least one flat head bolt is tightened until said core plug is secured within the hole.

19. The method of claim 15, wherein said core hole plug comprises at least one of the following shapes: rectangular, square, or circular.

* * * * *